US011737574B2

(12) United States Patent
Dudley

(10) Patent No.: US 11,737,574 B2
(45) Date of Patent: Aug. 29, 2023

(54) MATTRESS WITH AIRFLOW PASSAGES

(71) Applicant: Eric A Dudley, Meriden, CT (US)

(72) Inventor: Eric A Dudley, Meriden, CT (US)

( * ) Notice: Subject to any disclaimer, the term of this patent is extended or adjusted under 35 U.S.C. 154(b) by 21 days.

(21) Appl. No.: 17/148,479

(22) Filed: Jan. 13, 2021

(65) Prior Publication Data

US 2021/0204707 A1 Jul. 8, 2021

Related U.S. Application Data

(60) Provisional application No. 62/995,104, filed on Jan. 13, 2020.

(51) Int. Cl.

| | |
|---|---|
| ***A47C 21/04*** | (2006.01) |
| ***A47C 23/00*** | (2006.01) |
| ***A47C 27/00*** | (2006.01) |
| ***A47C 20/02*** | (2006.01) |

(52) U.S. Cl.

CPC ..... *A47C 21/046* (2013.01); *A47C 20/026* (2013.01); *A47C 23/00* (2013.01); *A47C 27/007* (2013.01); *A47C 27/00* (2013.01)

(58) Field of Classification Search

CPC ... A47C 20/025; A47C 20/026; A47C 21/042; A47C 21/04; A47C 21/046; A47C 20/00; A47C 23/00; A47C 27/00; A47G 9/1054

See application file for complete search history.

(56) References Cited

U.S. PATENT DOCUMENTS

| | | | | | |
|---|---|---|---|---|---|
| 2,807,033 | A * | 9/1957 | Austen | A47C 27/144 | 5/725 |
| 2,990,558 | A * | 7/1961 | Engel | A47C 27/144 | 5/725 |
| 3,315,282 | A * | 4/1967 | Lowery | A47G 9/1054 | 132/212 |
| 3,362,031 | A * | 1/1968 | Lemly | A47C 27/14 | 5/725 |
| 5,095,569 | A * | 3/1992 | Glenn | A47G 9/10 | 5/490 |
| 5,697,113 | A * | 12/1997 | Shatz | A47D 15/001 | 5/655 |
| 6,128,797 | A * | 10/2000 | Shaffer | A47C 27/146 | 5/724 |
| 6,230,350 | B1 * | 5/2001 | Goldstein | A47C 20/026 | 5/636 |
| 7,195,660 | B2 * | 3/2007 | Little | A47C 7/74 | 55/467 |
| 7,614,105 | B1 * | 11/2009 | Jackson | A47C 7/383 | 5/640 |
| 8,468,628 | B1 * | 6/2013 | Cheng | A47G 9/1054 | 5/652.2 |
| 8,776,292 | B2 * | 7/2014 | Ryan | A47G 9/10 | 5/636 |
| 10,842,287 | B1 * | 11/2020 | Vigil | A47C 21/044 | |
| 2009/0217459 | A1 * | 9/2009 | Rudolph | A47C 21/042 | 5/725 |

(Continued)

*Primary Examiner* — David R Hare

(57) ABSTRACT

A mattress allowing an individual to sleep in a prone position is provided. The mattress includes one or more internal cavities providing airflow to an openings formed in the mattress. The openings, which may be selectively closed, are sized for an average adult and are connected by way of the cavity to outlets which allow airflow. The reinforced cavities have filters and other features to increase user comfort.

4 Claims, 3 Drawing Sheets

(56) References Cited

U.S. PATENT DOCUMENTS

| | | | | |
|---|---|---|---|---|
| 2015/0040322 | A1* | 2/2015 | Cheng | A47G 9/109 5/636 |
| 2015/0289667 | A1* | 10/2015 | Oakhill | A47C 27/18 5/423 |
| 2018/0042409 | A1* | 2/2018 | Johnson | A61G 13/121 |
| 2020/0078242 | A1* | 3/2020 | Smith | A61B 5/024 |

* cited by examiner

MATTRESS WITH AIRFLOW PASSAGES

BACKGROUND OF THE INVENTION

1. Field of the Invention

The present invention generally relates to bedding. More specifically, the invention relates to a mattress allowing for airflow for prone sleepers.

2. Description of the Prior Art

Beds and mattresses are an essential part of everyday life. A mattress' main function is to provide the individual a comfortable cushion for a restful sleep. The construction of the mattress should therefore be able to provide comfort for the user during their sleep. To achieve maximum comfort the mattress' construction should accommodate the various positions that a person might assume while resting on the mattress. These various positions include lying on the back, the left or right side, and the abdomen, with certain individuals having ingrained preferences that cannot be modified. That is, regardless of the initial sleeping position, an individual will tend to turn to a preferred position during actual sleep. This behavior cannot be easily modified during an individuals lifetime.

For some individuals, sleeping in the prone position is the position which provides the most ideal comfort. However, conventional mattresses prohibit a full face-down sleeping position.

As readily perceived, an individual encounters difficulty in inhaling with their face down, and there are few pillows that provide a solution. In order overcome this problem, some people bend their neck so that their head rests to either side. Other people crook their elbow and place their forearm under their head to create a slight pocket of air between their face and the mattress. These approaches can lead to neck cramps and spinal misalignment.

In one aspect of the invention, the inventive mattress allows users to sleep in the face down position in order to treat or alleviate medical issues. Accordingly, the apparatus can be used to treat or minimize the danger of sleep apnea by providing the user with a face down sleeping position where the user has unobstructed breathing.

A mattress allowing an individual to sleep in a prone position is provided. The mattress includes at least an internal cavity providing airflow to an opening formed in the mattress. The opening, which may be selectively closed, is sized for an average adult and is connected by way of the cavity to outlets which allow airflow.

SUMMARY OF THE INVENTION

It is an object of the invention to provide an improved mattress.

It is a major object of the invention to provide an improved mattress having improved airflow.

It is another object of the invention to provide an improved mattress having cavities optimized for airflow for prone sleepers.

It is another object of the invention to provide an apparatus (e.g. removable breathing apparatus) for modifying a mattress to provide an airway for providing pressured air to prone sleepers.

DETAILED DESCRIPTION OF THE PREFERRED EMBODIMENTS

Figure 1:
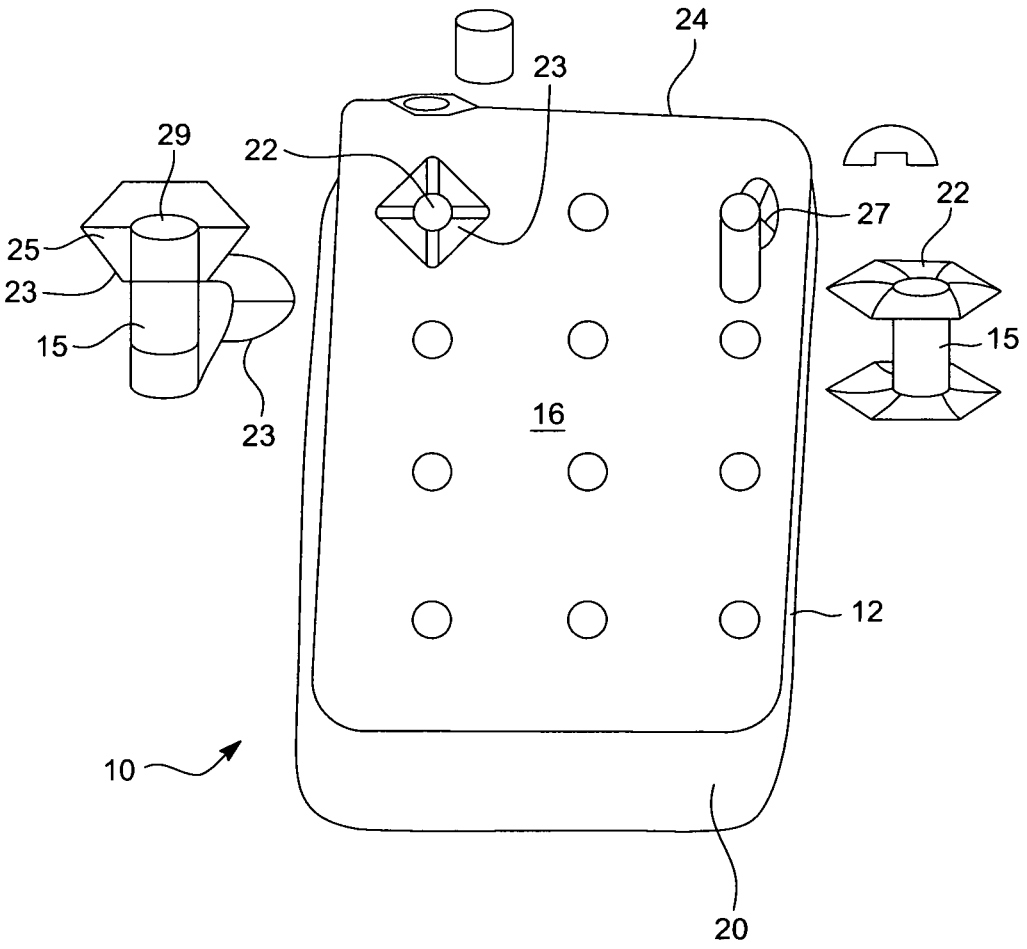
FIG. 1 shows a perspective view of the mattress of the invention.
Figure 2:
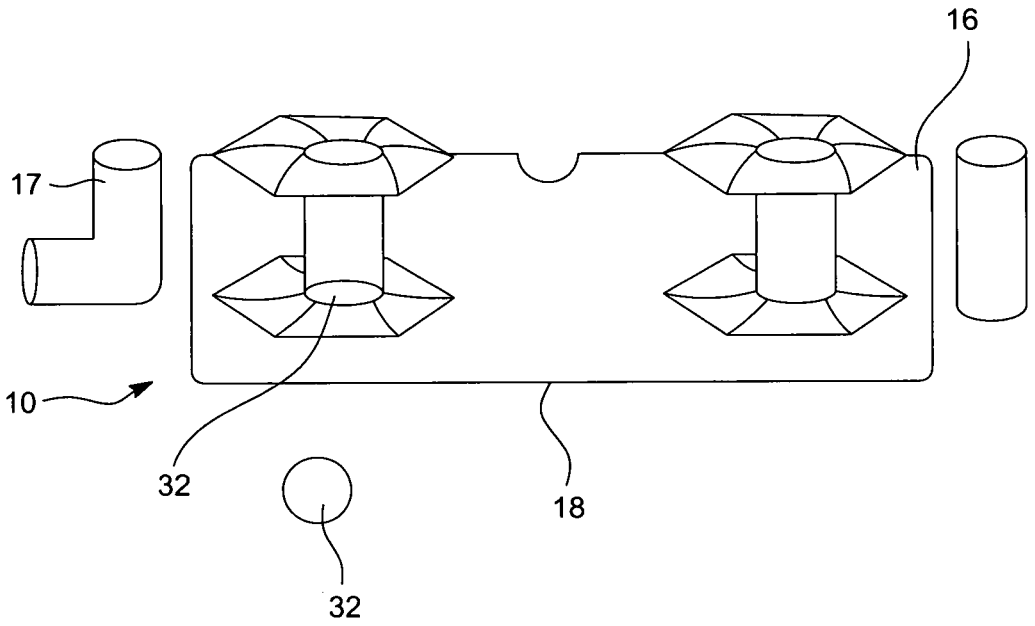
FIG. 2 shows a side view, partly in section, of the mattress of the invention.
Figure 3:
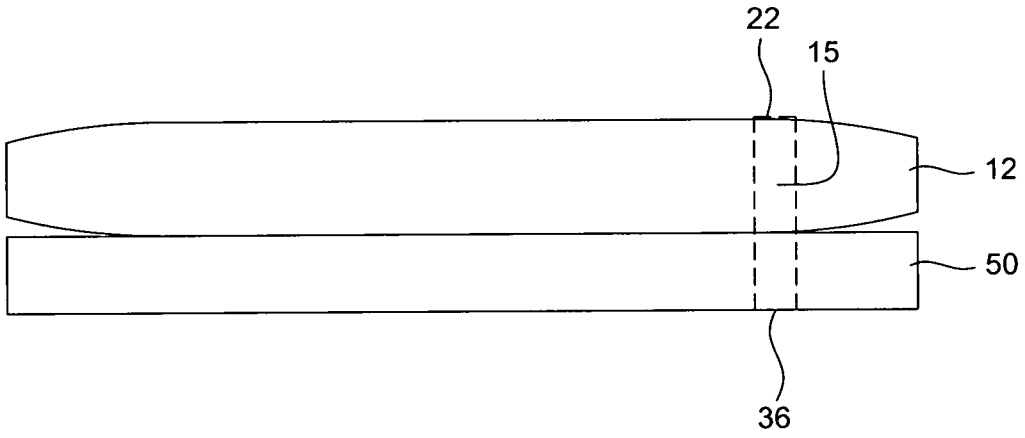
FIG. 3 shows a side view, partly in section, of the mattress of the invention used with a box spring.

Referring now to FIGS. 1-3, the mattress of the invention, generally indicated by the numeral 10, is shown. FIG. 1 depicts a mattress 12 with two cavities 14. While shown as having two cavities, a mattress with one or more cavities 14 may be made within the spirit of the invention. The mattress 12 can be of any size, shape, or construction, and may be used with a box spring 13 or other mattress foundation. In typical use the mattress 12 has an upper surface 16, a lower horizontal planar surface 18 and vertical side walls 20 that connect the upper and lower surfaces. As is common, the interior of the mattress is constructed with cushioning materials, e.g., coil springs, foam, air, etc.

Each cavity 14 as shown has a removable tubular conduit 15 positioned therein. An opening 22 formed in the mattress 12 is sized to receive the conduit 15, the opening sized for an average adult human face and positioned at one end 24 of the mattress 12. The opening 22 preferably has a generally oval cross section, the oval preferably elongated to conform to the shape (and orientation) of a user's face. The opening 22 may be between about 5 to 6 inches long, and about 4 inches wide so that a portion of an average adult's face may be positioned above the opening without the user's entire head falling into the opening and creating an unhealthy sleeping position. To that end, the opening is sized so that a typical user can rest the bridge of their nose and chin on padding positioned about the opening 22, with the user's mouth and nose positioned in or above the conduit 15. The size of the opening may be varied in accordance with the size of the intended user as would be apparent to one of skill in the art. The immediate area of the opening 22 (and outlets as will be explained later) and its surroundings can be lined with an odorless, washable insert 23, the insert padded and having an opening 29 sized for snug fit about respective ends of the conduit 15. The insert 23 acts as a headrest to provide a cushioned area for a user's head. The insert 23 is made removable to facilitate cleaning of the area about the opening 22. To that end insert 23 has e.g., hook and loop type material 25 affixed thereto, to releasably attach to a quantity of hook and loop type material 27 positioned on the mattress 12. A cushioned insert or plug 31 may be inserted into the opening 22 to provide a continuous upper surface 16 for other sleeping positions The conduit 15 is essentially a duct or airflow channel formed into the mattress 12. The conduit 15 may be removed for cleaning. While there are prior art mattresses having internal airflow they tend to suffer from drawbacks. The internal channels tend to be narrow so that air flow is minimal. In order to be effective, a fan is required to prevent exhaled air from accumulating in the channels. Persons with breathing difficulty or being oxygen deficient can have difficulty sleeping with these mattresses. Accordingly, the present invention uses air channels or passages that are nearly the width of the opening. The diameter of the cavity 14 is only slightly less than the opening 22, or about 3 to 5 inches. A removable filter 32 may be positioned within the conduit 15 to filter incoming air. These filters 32 may be formed of a rigid material such as a hard plastic and sized for frictional fit within the conduit 15.

As can be seen best in FIG. 2, the cavity 14 can have an outlet 36 at the head of the mattress 12, or in the lower surface 18. If the outlet 36 is in the lower surface 18 the conduit 15 is straight, and if the outlet 36 is at the head of the mattress 24 then conduit 17 is bent as seen in FIG. 2. With either configuration, an insert 23 may optionally be positioned about the outlet 36 which can be removed and cleaned.

FIG. 3 shows a mattress 12/box spring 50 combination. It can be seen that the box spring 50 also has a cavity 52 through which a conduit 15 and associated insert may be inserted. In this arrangement, the cavity 52 should be straight and not curved.

In a key aspect of the invention, Insert 23, duct 15, 17, and plug 31 may be sold separately for use with a mattress 12 which is preformed with a cavity 14.

It is to be understood that the present invention is not limited to the sole embodiment described above, but encompasses any and all embodiments within the scope of the following claims.

I claim:

1. A mattress having internal airflow comprising:

a generally flat main body having vertically oriented sidewalls and opposing end portions, and upper and lower surfaces;

one or more cavities disposed interiorly of said main body and having one or more outlets formed in said sidewalls of said mattress;

an opening formed in said upper surface of said mattress;

whereby said opening is in communication with said outlets to provide ambient air to said opening;

wherein said one or more cavities are configured to receive a removable conduit therein;

wherein said conduit is configured to allow passage of ambient air therethrough;

wherein said conduit is configured to be removed by a user for cleaning and/or replacement; and wherein said opening is surrounded by a removable insert configured to facilitate cleaning of an area about the opening and configured provide a cushioned area for a head of the user.

2. The mattress of claim 1, wherein said opening is sized for the head of the user.

3. The mattress of claim 1 wherein a removable filter is configured to be positioned within the conduit to filter incoming ambient air.

4. The mattress of claim 1 further comprising a box spring underneath the mattress, wherein the box spring has a second cavity through which the conduit and removable insert is inserted.

* * * * *